United States Patent [19]

Musil

[11] Patent Number: 4,940,334

[45] Date of Patent: Jul. 10, 1990

[54] REVERSE FLOW MIXING METHOD FOR DIRECT-FIRED ASPHALTIC CONCRETE DRUM MIXERS

[75] Inventor: Joseph E. Musil, Ely, Iowa

[73] Assignee: Cedarapids, Inc., Cedar Rapids, Iowa

[21] Appl. No.: 286,218

[22] Filed: Dec. 19, 1988

Related U.S. Application Data

[62] Division of Ser. No. 089,179, Aug. 25, 1987, Pat. No. 4,813,784.

[51] Int. Cl.[5] ..... B28C 5/20; B28C 5/46; B28C 7/12; B28C 7/16

[52] U.S. Cl. ..... 366/4; 366/24; 366/25; 366/34; 366/42; 366/57; 366/59; 366/149; 366/228; 34/136; 432/117; 432/118

[58] Field of Search ..... 366/22–25, 366/4, 34, 40, 42, 54, 57–59, 27, 28, 144, 149, 220, 228; 34/128, 136; 432/108, 111, 117, 118

[56] References Cited

U.S. PATENT DOCUMENTS

| | | | |
|---|---|---|---|
| 1,336,422 | 4/1920 | Burman | 34/136 |
| 1,867,739 | 7/1932 | Frazer | 366/25 |
| 2,487,887 | 11/1949 | McEachran | 366/24 |
| 4,089,508 | 5/1978 | Anderson | 366/25 |
| 4,136,966 | 1/1979 | Mendenhall | 366/25 |
| 4,296,072 | 10/1981 | Takacs et al. | 366/25 |
| 4,300,837 | 11/1981 | Malbrunot | 366/25 |
| 4,600,379 | 7/1986 | Elliott | 366/25 |

FOREIGN PATENT DOCUMENTS

| | | | |
|---|---|---|---|
| 438230 | 5/1912 | France | 34/136 |
| 882078 | 5/1943 | France | 34/136 |
| 1013091 | 7/1952 | France | 366/34 |
| 2377593 | 9/1978 | France | 34/136 |
| 190480 | 4/1937 | Switzerland | 432/108 |

*Primary Examiner*—Harvey C. Hornsby
*Assistant Examiner*—Joseph S. Machuga
*Attorney, Agent, or Firm*—Simmons, Perrine Albright & Ellwood

[57] ABSTRACT

A reverse flow post-mixer attachment for direct-fixed asphaltic concrete mixers includes a modified discharge box for the downstream end of the drum and an enclosure for the downstream portion of the drum forming a passage along the exterior of the drum. If the smoke point of the liquid asphalt to be added to the material in the drum meets an established standard it is injected into the material upstream of the downstream end of the drum and discharged from the latter end in the normal manner. If the smoke point of the asphalt does not meet the standard, the material exiting the drum is diverted into the passage along the exterior of the drum and the asphalt added there out of the burner stream in the durm. The material and asphalt are then mixed and moved through the passage and finally discharged.

7 Claims, 4 Drawing Sheets

REVERSE FLOW MIXING METHOD FOR DIRECT-FIRED ASPHALTIC CONCRETE DRUM MIXERS

CROSS REFERENCE TO RELATED APPLICATION

This application is a division of application Ser. No. 07/089,179 filed Aug. 25, 1987 now U.S. Pat. No. 4,813,784.

BACKGROUND OF THE INVENTION

Drum type mixers for the production of asphaltic concrete or the recycling of used asphaltic pavement are afflicted with two ills, the production of blue smoke and the emission of particulates. The first arises because asphaltic drum mixers are typically of the "direct-fired" kind, meaning that there is direct contact of the hot burner gases with the asphalt. The second results because dust and fines from the aggregate or recycle material are entrained in the stream of hot air and gases through the drum. Current Federal standards limit smoke, referred to as the "opacity", to 20 percent vision impairment and the emission of particulates to no more than 0.04 grains per dry standard cubic foot ("GR/DSCF"). The latter standard is easily achieved with current bag houses but the former standard is another matter entirely.

Opacity arises, it has been found, not from the asphalt in old pavement being recycled—its asphalt is too old, too brittle, and too oxidized to contribute much to the smoke problem. Rather opacity stems chiefly from the lighter fresh asphalt, whether that added to all virgin aggregate or that added to recycled pavement. Mysteriously, asphalts of the same penetration and the same viscosity—the two indices by which all asphalts are graded—can have totally different smoke points. An asphalt obtained from one source may have a lower or higher smoke point than an asphalt of identical grade obtained from another source. One simply cannot tell whether an asphalt will or will not abide by the standard until it is actually injected into the heat of the drum. Consequently, to thwart the opacity problem the asphalt injection point has been moved further and further downstream in the drum. But that in turn often unduly shortens the span over which the fresh asphalt is mixed with the aggregate or recycled pavement—unless the drum is lengthened to compensate. Lengthening the drum, however, adds to cost and, more critically, encumbers the portability of the drum mixer. This is important because the majority of drum mixers are portable. Another tack, also encumbering and costly, has been to empty the drum mixer into, in effect, a wholly separate drum or a pugmill and add the fresh asphalt there, out of the burner's stream.

So the primary objects of the present invention are to accommodate liquid asphalts of low smoke points without lengthening the drum and without the need for an additional drum, pugmill or the like, all in order to preserve portability of the plant and to minimize cost. Another object of the invention is to do so with components which can be supplied either as an option to a drum mixer on order or as a "retro-fit" kit or attachment for one already in the field. A further object of the invention is also to do so in a manner which allows the drum mixer to be operated in normal fashion when the smoke point of the asphalt used is high enough to meet the opacity standard.

SUMMARY OF THE INVENTION

The objects of the invention are achieved by increasing the effective length of the drum without at the same time increasing its overall length. This seeming paradox is accomplished by an attachment which includes stationary housing for spacedly encompassing the downstream portion of the drum with respect to the direction of material flow through the drum, the burner being at the upstream end of the drum. The upstream portion of the housing includes a lower semi-circular wall concentric with the drum and forming a semi-annular passage between that wall and the drum. One end of the housing lower wall extends a short distance beyond the downstream end of the drum in order to receive material exiting the drum. The rear or downstream portion of the housing constitutes an alternate discharge box replacing the normal one for the particulate laden air and hot gases from the drum, which box in turn is connectable to a typical bag house. The normal discharge blades at the downstream end of the drum itself are replaced with skewed blades which move the material exiting the drum first onto the adjacent end of the lower housing wall and then into the semi-annular passage between the drum and the lower housing wall, thus reversing the direction of flow of the material. The exterior of the drum encompassed by the housing is fitted with paddles or the like which mix the material and move it in the reverse direction through the semi-annular passage to an alternate discharge port adjacent the other end of the lower housing wall.

The fresh asphalt is introduced through an alternate pipe onto the material adjacent the upstream end of the semi-annular passage so that the asphalt is thoroughly mixed with the material by the paddles or the like as it passes between the drum and the lower housing wall. The latter wall is heated by hot oil passing through ducts secured to its exterior in order to bring the wall up to proper temperature when the plant is started and to maintain the mix at the proper temperature thereafter. Hence, the effective length of the drum is increased by the length of the semi-annular passage and since the asphalt is injected adjacent the upstream end of that passage, it is substantially out of the burner stream and thus kept below its smoke point. The overall length of the drum mixer is not increased because the discharge box portion of the housing is merely greater in its transverse dimensions than the normal one. Hence the apparatus of the invention is aptly designated a "reverse flow post-mixer".

Inasmuch as, depending on the smoke point of a particular asphalt, the post-mixer need not always be used, preferably the drum mixer should be capable of normal operation when the smoke point of the asphalt meets or exceeds the opacity standard, but readily switched to the post-mixer when the smoke point of the asphalt does not. To that end the lower housing wall just below the downstream end of the drum is provided with a normal discharge port which can be opened or closed by a door. The normal asphalt injection pipe is retained, the alternate pipe being branched off the former and a valve provided at the branch so that flow can be switched from one pipe to the other. When operating conventionally, the normal discharge port is open, the normal discharge blades are used, and asphalt flow is directed through the normal pipe. The drum mixer then functions in customary manner. Simply closing the normal discharge port, replacing the normal discharge blades with the skewed blades, and switching asphalt flow to the alternate pipe invokes the post-mixer when needed. Thus the method aspect of the invention involves operating the drum mixer either normally when the smoke point of the asphalt meets the standard, or alternately, when it does not, so that the flow of material after it has departed the drum is reversed and flowed along an exterior portion of the drum where it is mixed with the asphalt.

All the components of the post-mixer attachment can be either fitted, as an option, to a drum mixer at the time it is manufactured, or can be supplied as a "kit", as it were, for ready fitting to a drum mixer already in the field after removal of its discharge box. Other features and advantages of the present invention will be apparent from the drawings and from the more detailed description which follows.

DETAILED DESCRIPTION OF THE PREFERRED EMBoDIMENT

Figure 1:
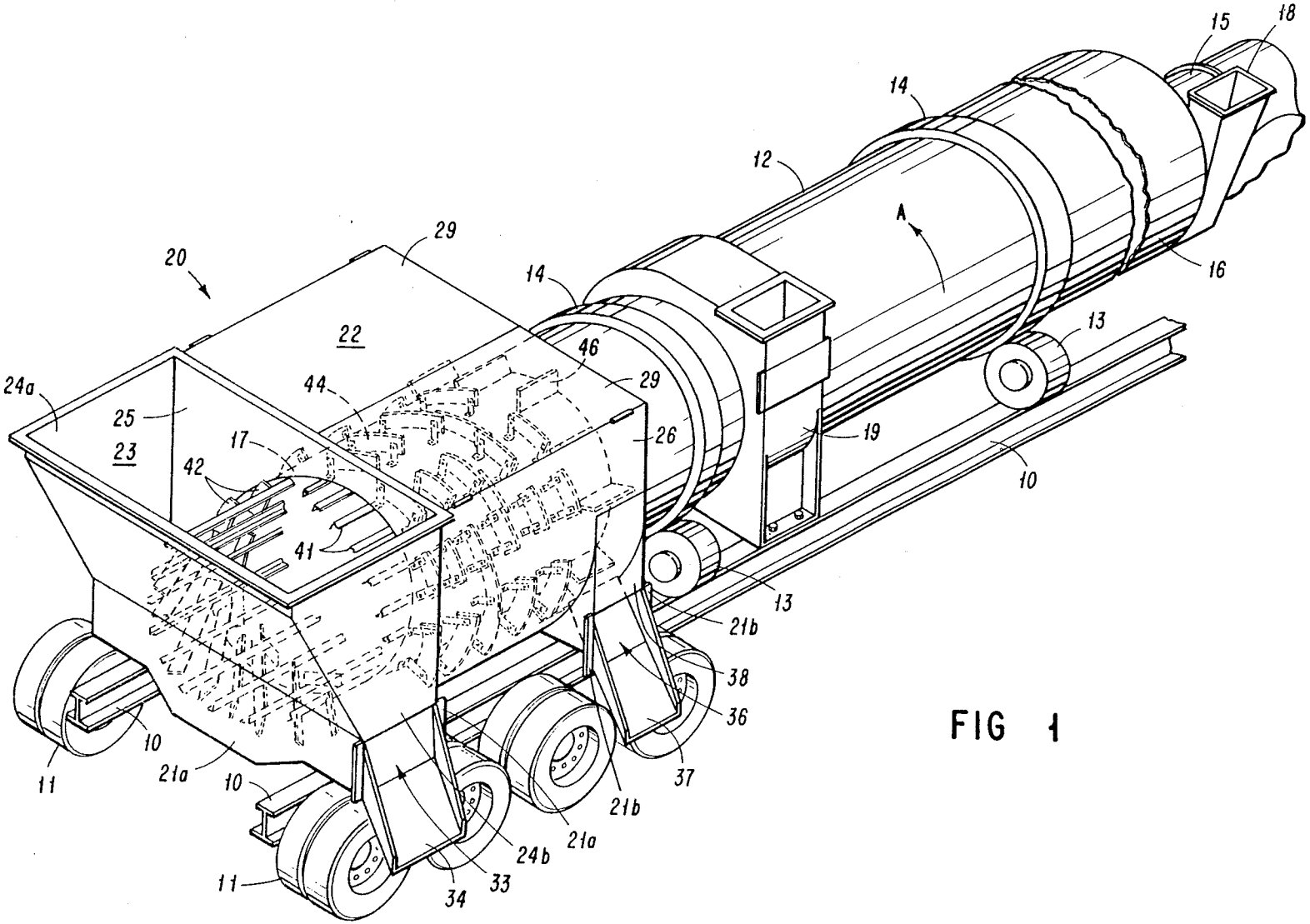
FIG. 1 is a perspective view of a portion of a typical direct-fired drum mixer shown with the post-mixer attachment of the invention applied to it.

The direct-fired drum mixer shown in FIG. 1 is typical of those currently in use. A frame 10, which is provided with wheels 11 in order for the mixer to be portable, supports a cylindrical drum 12 on two spaced pairs of rollers 13 (only one of each pair being shown in FIG. 1) disposed intermediate the ends of the drum 12, the rollers 13 revolving against a pair of steel "tires" 14. The drum 12 is rotated about its axis in the direction shown by the arrow "A" by a "positive cradle chain drive" (not shown) of a type well-known in the art. A burner 15 at the upstream end 16 of the drum 12 discharges air and hot gases through the interior of the drum 12 and out its downstream end 17 into a discharge box which in turn leads to a bag house (not shown) for filtering particulate matter exhausted from the drum 12. A chute 18 introduces material into the drum 12 at its upstream end 16 which then moves through the drum 12 to its downstream end 17. The mixer may also have provision for recycling used asphalt pavement, such as that shown in U.S. Pat. No. 4,395,129 to Musil, and generally indicated at 19 in FIG. 1.

Figure 2:
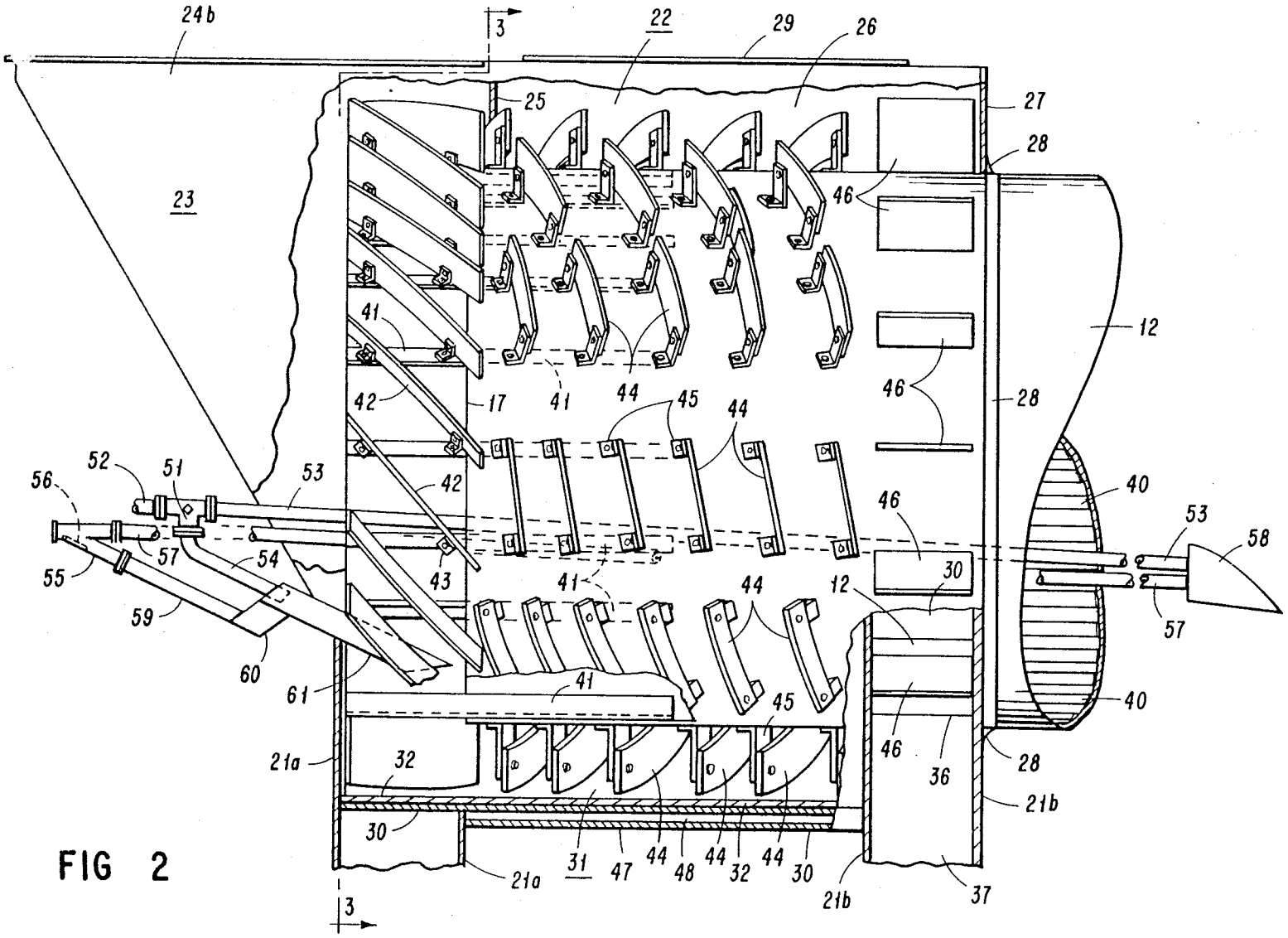
FIG. 2 is a side elevational view of a portion of FIG. 1, certain parts being broken away and sectioned to illustrate various details of the invention.
Figure 3:
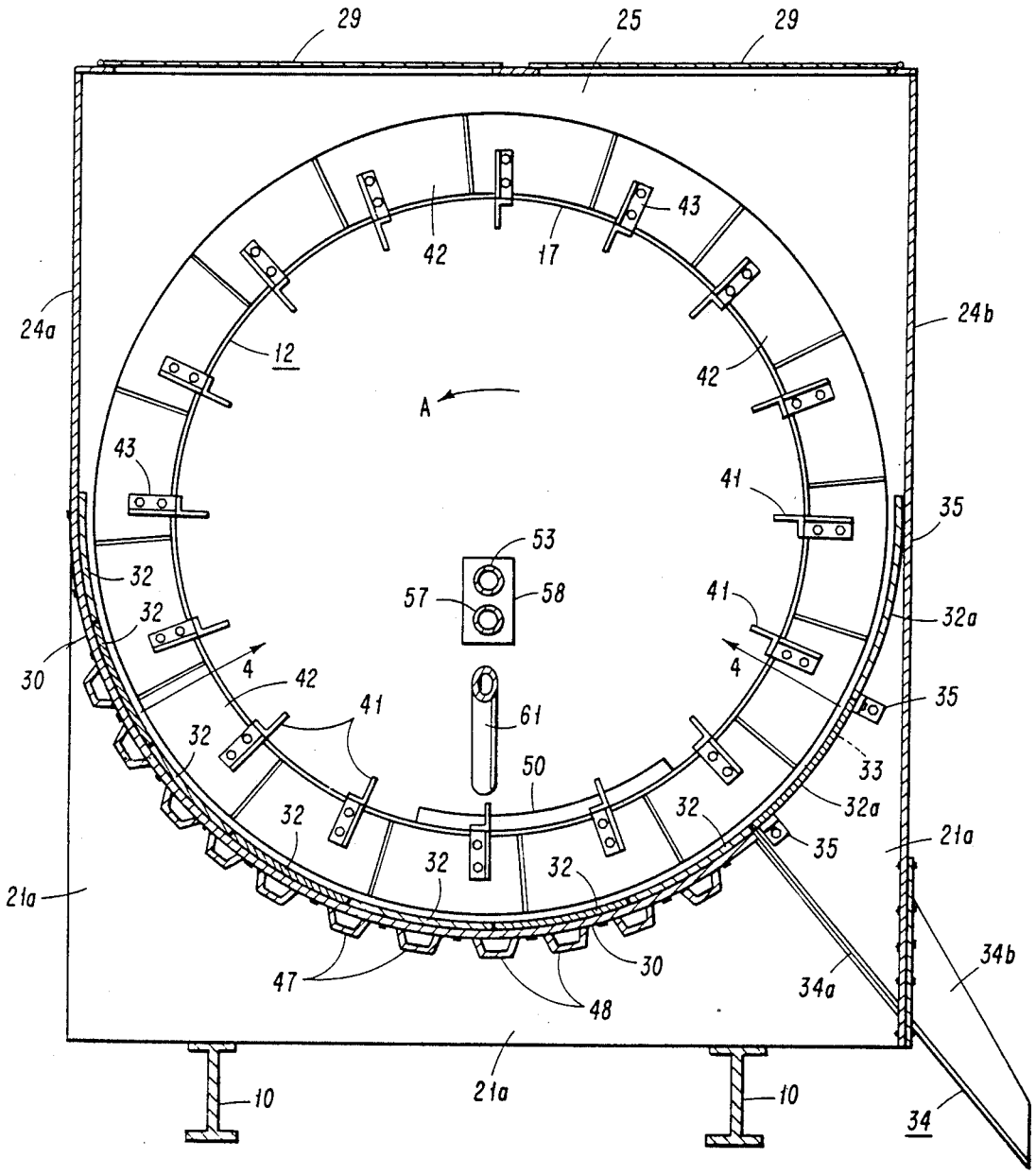
FIG. 3 is a sectional view taken along the line 3—3 of FIG. 2.

When the drum mixer is equipped with the post-mixer attachment of the invention the normal discharge box is replaced with a stationary enclosure or housing, generally indicated at 20, supported on the frame 10 by two pairs of transverse plates **21*a* and 21*b* (see FIGS. 1–3). The housing 20 consists essentially of two parts, a semi-sleeve 22 spacedly enveloping the downstream portion of the drum 12 beyond the rear rollers 13 and "tire" 14 and joined to an alternate discharge box 23, the rearmost transverse plate 21*a* forming the lower rear end wall of the box 23. The box 23 further includes side walls 24*a* and 24*b* and a front end wall 25 at the downstream end 17 of the drum 12 which opens through the box end wall 25, the top of the box 23 being open for discharge of air and hot gases to the bag house. The upper half of the sleeve 22 includes a pair of flat side walls 26, a front end wall 27 apertured to receive the drum 12 and provided with a circular lip seal 28 against the rotating exterior of the drum 12, and a flat top wall in the form of a pair of hinged doors 29 for access to the interior of the sleeve 22. The box sidewall 24*a* and the sleeve side walls 26 extend down level with the axis of the drum 12 and their lower halves form an arcuate bottom wall 30 concentric with and spaced from the exterior of the drum 12, the wall 30 extending back to the rear-most transverse plate 21*a* and also constituting the bottom wall of the discharge box 23. Consequently, the lower half of the drum 12 and the bottom wall 30 together define a semi-annular tunnel or passage 31 extending from the downstream end 17 of the drum 12 to the forward-most transverse plate 21*b* which also forms the front end wall of the lower half of the sleeve 22**.

The inner surface of the bottom wall 30 is covered by segmental wear plates 32 and the wall 30 downstream of the passage 31 is provided with a normal material discharge port 33 somewhat past the bottom dead center of the drum 12 with respect to its direction of rotation "A" (see FIGS. 1 and 3). An inclined discharge chute 34 for the port 33 is formed by a floor plate **34*a* between the adjacent pair of transverse support plates 21*a*, the floor plate 34*a* emerging below the adjacent discharge box side wall 24*b* (see FIG. 1), and formed therebeyond with upright side walls 34*b* which are secured in turn to flanges on the adjacent ends of the two transverse plates 21*a* in order to support the chute 34. The discharge port 33 is opened and closed by a portion 32*a* of one of the wear plates 32, which portion 32*a* may be removably bolted at 35 to the two transverse support plates 21*a* (see FIG. 3) or simply slid up and down to open and close the port 33. An alternate discharge port 36 (see FIGS. 1 and 2) is provided through the other end of the wall 30 and wear plates 32 between the two transverse plates 21*b* and positioned like the port 33 with respect to the bottom dead center of the drum 12. A similar discharge chute 37 is fitted to the port 36 between the adjacent two transverse plates 22*b* and below a plate 38 depending from the sleeve side wall 26 between the two plates 22*b* (see FIG. 1**).

Figure 4:
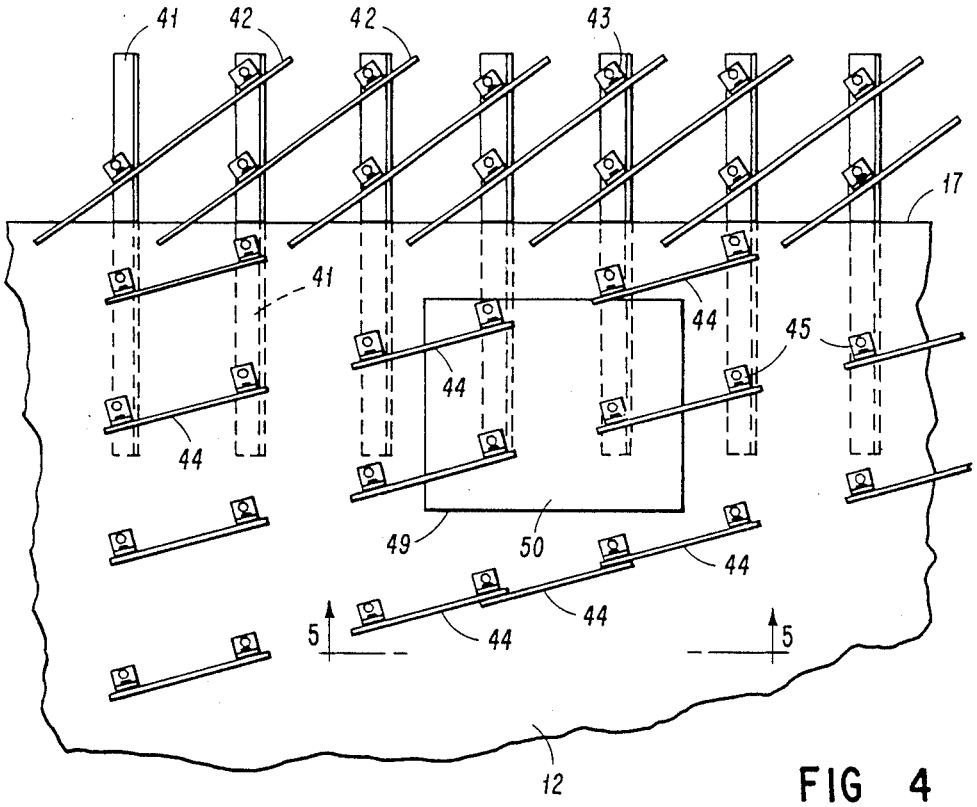
FIG. 4 is a detail view taken along the line 4—4 of FIG. 3.
Figure 5:
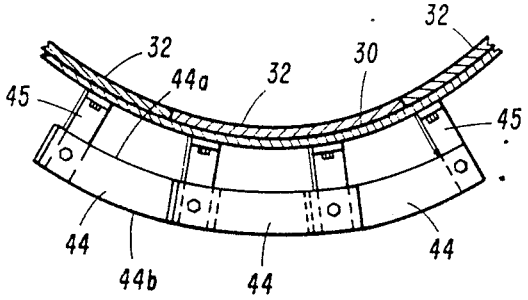
FIG. 5 is a sectional view taken along the line 5—5 of FIG. 4.

The downstream-most end of a drum mixer is typically fitted with a circle of rearwardly extending angle members 41 parallel to the axis of the drum and downstream of the regular flighting 40 indicated in FIG. 2. Those angle members 41 typically support a circle of normal discharge blades parallel to the axis of the drum. These blades are replaced with a circle of alternate discharge blades 42 on brackets 43, the blades 42 being skewed with respect to the direction "A" of drum rotation effective to push material exiting the drum 12 onto what then becomes the upstream end of the passage 31. Obviously other suitable means could be employed to mount the blades 42. The exterior of the drum 12 within the sleeve 22 is fitted in turn with a large number of "paddles" 44 mounted on brackets 45 which may be secured to the drum 12 using the bolt holes of the flighting 40 and angle members 41. The paddles 44 which are of equal lengths are arranged to form in effect several helical flights around the exterior of the surface of the drum 12 in order to move the material through the passage 31. The ends of the paddles 44 of each flight may be spaced apart end-to-end, as shown in FIGS. 2 and 4, to form short lengths, or some or all can be joined at their ends to form longer lengths, of each flight, as shown in FIGS. 4 and 5. Note from FIG. 5 that the height of the paddles 44 is less than the radial thickness of the passage 31 so as to leave spaces between the drum 12 and the inner longitudinal edges 44*a* of the paddles 44 in order to mix as well as to move material in the passage 31, the opposite outer longitudinal edges 44*b* of the paddles 44 in turn closely abutting the wall 30. By using paddles 44 of different heights, or by joining the paddles 44 end-to-end in some of the flights, or even by altering the angle of pitch of the paddles 44, or by doing all or some of these, various combinations of rate of movement versus degree of mixing of the material can be achieved. Spacing the paddles 44 of one or more flights apart, or decreasing the height of the paddles 44, or decreasing the pitch of the paddles 44, or again doing all or some of these, will slow movement of the material but increase its mixing, and vice versa. At what then becomes the downstream end of the passage 31, the exterior of the drum 12 is fitted with a circle of radially extending discharge blades 46 parallel to the axis of the drum 12 which urge the material into the alternate discharge port 36 and down the chute 37.

The exterior of the bottom wall 30 is provided with a number of hat-section channels 47 (see FIGS. 2 and 3) secured thereto to form ducts 48 for the circulation of hot oil in order to bring the wall 30 up to proper temperature when the plant is started-up and to help maintain the temperature of the material as it proceeds through the passage 31. An opening 49 (see FIG. 4) closely adjacent the downstream end 17 of the drum 12 and closed by a door 50 (see FIG. 3) is preferably included through which to inspect and if necessary replace the wear plates 32. A valve 51 is inserted in the normal liquid asphalt supply pipe 52 for directing the asphalt either normally into the drum 12 well upstream of its downstream end 17 through a pipe 53 or through an alternate pipe 54. Fabric filter dust from the bag house arrives at a branch fitting 55 containing a flap valve 56 to direct the dust either normally through a pipe 57 where it joins the asphalt in a mixer 58 at the downstream ends of the pipes 53 and 57, or alternately through a pipe 59 leading to a fitting 60 over the end of the asphalt pipe 54 which injects the dust tangentially into the asphalt. The asphalt and dust then pass through a larger pipe 61 extending down as close as possible to the upstream end of the passage 31 without striking the angle members 41 during rotation of the drum 12.

As mentioned before, the post-mixer attachment of the invention can be fitted as an option to a drum mixer during its initial manufacture, or supplied as a kit for fitting to a drum mixer in the field. Since all commercially available drum mixers support the drum intermediate its ends, as on rollers 13 and "tires" 14, and since the downstream roller and "tire" are typically distant from the downstream end of the drum about one-quarter of the length of the drum, the downstream-most portion of the drum is in effect cantilevered with respect to the frame below. Hence, when supplied as a retro-fit in the field, the normal discharge box can be simply removed, after removal of the normal discharge blades at the downstream end of the drum, and the housing 20, complete with the wear plates 32 and chutes 34 and 37, placed on the frame 10 and slipped over the adjacent cantilevered portion of the drum 12. The skewed discharge blades 42 can then be installed through the open top of the discharge box 23, and the paddles 44 and blades 46 secured on the drum 12 after opening the doors 29, by rotating the drum 12 step-by-step. With the wear plate or door 32*a* removed, the normal discharge blades re-installed, and the asphalt and dust directed through the pipes 53 and 57, the drum mixer functions normally when the smoke point of the liquid asphalt is high enough to keep smoke within the opacity limit, the material being discharged by the normal discharge blades through the port 33 and down the chute 34 at the downstream end of the drum 12. If the smoke point of the asphalt is too low, the door 32*a* is bolted in place, the skewed discharge blades 42 are installed, hot oil is supplied to the ducts 48, and the asphalt and dust switched to the pipes 54 and 59. The asphalt and dust are thus directed into the material as the blades 42, owing to the closure of the discharge port 33, move the material into the upstream end of the passage 31. In the latter, the asphalt and dust are thoroughly mixed with the material by the paddles 44 as they at the same time move the material through the passage 31 to its downstream end where the discharge blades 46 direct it through the discharge port 36 and down the chute 37. Other aspects of the structure and operation of the invention will be apparent to those of skill in the art.

Though the invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. In a direct-fired asphaltic concrete drum mixer, including a drum having upstream and downstream portions with respect to the direction of flow of material therethrough, the upstream portion having an upstream end for introducing the material into the drum and the downstream portion having a downstream end for discharging the material from the drum, the mixer further including a normal discharge port and chute adjacent the downstream end for receiving the discharged material and a burner communicating with the drum for moving air and hot gases through the drum, a method of operating the mixer with a first liquid asphalt or alternatively with a second liquid asphalt, the first asphalt having a smoke point which meets and the second asphalt having a smoke which does not meet a predetermined standard of desirable opacity of air and hot gases exiting the drum when the respective ashphalt is introduced into the drum, the method comprising: moving material through the drum toward its downstream end while subjecting the material to the air and hot gases discharged by the burner through the interior of the drum; injecting asphalt into the drum upstream of its downstream end; mixing the material and the asphalt in the drum while moving the same toward the downstream end of the drum; and discharging the "mixed material and asphalt" from the downstream end of the drum; comparing the opacity of the air and hot gases discharged from the drum against the desired opacity, and, if the opacity is greater than a desired maximum, and, hence the asphalt is determined to be of the second type, switching the asphalt from being injected into the drum to being directed into an upstream end of a material passage extending externally of the drum from adjacent the normal discharge port and chute external of and along the downstream portion of the drum in the direction of its upstream end, hence moving only the material through the drum towards its downstream end while subjecting the material to the air and hot gases discharged by the burner through the interior of the drum; discharging only the material from the downstream end of the drum; closing off the normal discharge port and urging the discharged material into the passage; moving the discharged material so that it thereafter proceeds it a direction towards the upstream end of the drum while maintaining the discharged material adjacent the exterior surface of the downstream portion of the drum; injecting the second liquid asphalt while so moving and maintaining the material; mixing and heating the material and the second liquid asphalt while so moving and maintaining the material; and thereafter discharging the heated mixed material and second liquid asphalt.

2. The method of claim 1 wherein the material is maintained adjacent the exterior of the downstream portion of the drum by an enclosure spacedly embracing said downstream portion of the drum, the enclosure representing an outer wall of the passage, the outer wall having a plurality of ducts, wherein the step of moving only the material further comprises advancing the material by means mounted around the exterior of the surface of the drum at a pitch for moving the material by rotation of the drum with respect to the enclosure while mixing the material and the asphalt, and prior to closing off the normal discharge port and urging the material into the passage, flowing heated oil through the ducts, raising the temperature of the outer wall with the heated oil, and maintaining a stationary heated wall concentric with the drum and spaced from the lower exterior of said downstream portion of the drum.

3. In a method of heating material in a mixer with a stream of air and hot gases within a drum while moving the material from an upstream end of the drum to a downstream end of the drum, including feeding the material into the drum at the upstream end thereof, combining and mixing the material with liquid asphalt, and discharging the mixed material and asphalt through a discharge chute, the improvement comprising:

selectively directing the asphalt to being combined with the material either within the drum intermediate the upstream and downstream ends in the presence of the air and hot gases, or to being combined with the material, after discharging the material from the drum at the downstream end thereof, at a first end of a passage extending externally of and adjacent the drum from adjacent the downstream end of the drum along the drum toward the upstream end of the drum with a second end of the passage disposed along the drum intermediate the upstream and downstream ends thereof;

selectively discharging the material from the mixer through a first discharge port and chute at the first end of the passage adjacent the downstream end of the drum by maintaining open the first discharge port and chute, or discharging the material at a second discharge port and chute at the second end of the passage by closing off the first discharge port and moving the material through the passage to the second discharge port and chute; and directing the asphalt to being combined with the material after discharging the material from the drum at the downstream end thereof only in combination with discharging the material from the mixer at the second discharge port and chute at the second end of the passage.

4. A method according to claim 3, the method further including closing the first discharge port and chute at the first end of the passage when, upon combining the asphalt with the material within the drum, the air and hot gases exiting the drum have an undesirable characteristic resulting from the exposure of the asphalt to the air and hot gases within the drum; and only then mixing the material with the asphalt while moving the material through the passage to the second discharge port and chute.

5. A method according to claim 4, wherein the method further comprises:

heating the outer wall of the passage by flowing a hot fluid through a plurality of ducts disposed on the outside of the outer wall of the passage.

6. A method according to claim 5, wherein the step of heating comprises:

flowing heated oil through the plurality of ducts disposed on the outside of the outer wall of the passage to heat the ducts prior to and during the step of mixing the material with the asphalt while moving the material through the passage.

7. A method according to claim 3, wherein the step of selectively discharging the material from the mixer through a first discharge port and chute, or discharging the material at a second discharge port and chute further includes mixing the material and the asphalt while selectively moving the material through the passage to the second discharge port and chute.

* * * * *